United States Patent [19]

Waters

[11] Patent Number: 5,011,436

[45] Date of Patent: Apr. 30, 1991

[54] HERMAPHRODITIC KEYS

[75] Inventor: Mark H. Waters, Harrisburg, Pa.

[73] Assignee: AMP Incorporated, Harrisburg, Pa.

[21] Appl. No.: 338,533

[22] Filed: Apr. 14, 1989

Related U.S. Application Data

[63] Continuation of Ser. No. 270,489, Nov. 4, 1988, abandoned, which is a continuation of Ser. No. 90,293, Aug. 31, 1987, abandoned.

[51] Int. Cl.[5] ..... H01R 13/64

[52] U.S. Cl. ..... 439/681; 439/78

[58] Field of Search ..... 439/677–681, 439/374–380, 217, 218, 78

[56] References Cited

U.S. PATENT DOCUMENTS

| | | | |
|---|---|---|---|
| 3,611,272 | 10/1971 | Fairbairn et al. | 439/681 |
| 4,350,409 | 9/1982 | Kato et al. | 439/681 |
| 4,379,606 | 4/1983 | Clark et al. | 339/17 CF |
| 4,509,258 | 4/1985 | Locati et al. | 439/378 |
| 4,790,763 | 12/1988 | Weber et al. | 439/681 |

FOREIGN PATENT DOCUMENTS

| | | | |
|---|---|---|---|
| 586962 | 4/1977 | Switzerland | 439/681 |

OTHER PUBLICATIONS

AMP Inc., Handbook HB5614, pp. 3 & 4.

AMP Inc., "Terminator" Article, p. 4.

U.S. Ser. No. 423,486, filed 9/24/82.

*Primary Examiner*—David L. Pirlot

*Attorney, Agent, or Firm*—David L. Smith

[57] ABSTRACT

According to one aspect, the invention comprises an hermaphroditic key assembly for electrical connectors which includes a first connector (10) having first and second pairs of diametrically opposed key positions (41*a*, 41*b*, 41*c*, 41*d*) at either of which a pair of keys (42*a*, 42*b*) may be provided, and a second connector (12) having first and second pairs of diametrically opposed key-receiving positions (46*a*, 46*b*, 46*c*, 46*d*) at either of which a pair of key-receiving openings (47*a*, 47*b*) may be provided. The connectors (10, 12) are permitted to mate when the diametrically opposed keys (42*a*, 42*b*) are aligned with the diametrically opposed key-receiving openings (47*a*, 47*b*), and are not permitted to mate when the keys (42*a*, 42*b*) are not aligned with the openings (47*a*, 47*b*), providing two possible keying orientations for the keying means. According to a further aspect of the invention, the hermaphroditic keying assembly is used in conjunction with a further keying element, such as a polygonal keying element, to double the number of available keying combinations possible with the other keying assembly alone.

12 Claims, 3 Drawing Sheets

HERMAPHRODITIC KEYS

This application is a continuation of application Ser. No. 270,489 filed Nov. 4, 1988, now abandoned, which is a continuation of application Ser. No. 090,293 filed Aug. 31, 1987, now abandoned.

BACKGROUND OF THE INVENTION

The present invention relates generally to electrical connectors, and, more particularly, to keying systems for electrical connectors.

Electrical connectors are frequently provided with keying means to permit particular pairs of connectors to properly mate and to prevent the mating of connectors which are not intended to be mated. Keying means are especially useful when a plurality of identical connectors are positioned in close proximity to one another, for example, on a printed circuit board. The incorrect matching of complementary connectors to the connectors on the board can cause serious damage to the circuits improperly connected thereby; and the keying means, by ensuring that each complementary connector will mate with only the correct one of the plurality of connectors on the board, minimizes the risk of improper connection. Keying means are particularly important when the connections are made by untrained personnel as the risk of improper connection is especially great in such circumstances.

In one known type of keying system, one of a pair of complementary connectors is provided with a plurality of projections and the other of the pair of connectors is provided with a plurality of recesses or cavities. As the connectors are mated, the projections extend into and are received within the recesses allowing the connectors to properly mate. If the projections and recesses are not correctly aligned with respect to one another, however, proper mating will not occur.

Such keying systems are often not fully satisfactory. Frequently, the keying systems require that the connectors themselves be oriented with respect to one another in a particular way to operate properly. Also, the keying systems are often not effective in preventing mating of a keyed connector with an unkeyed connector.

In another known type of keying system, a key member is secured in one of a pair of complementary connectors and is adapted to cooperate with an opposing key member secured in the other of the pair of connectors. Each key member is secured in its connector in a selected orientation with respect to its opposing key member so that when the connectors are intended to be mated, extended keying portions on the key members pass by each other during mating to allow the connectors to properly mate. If one of the key members is secured in an incorrect orientation with respect to its opposing key member, however, the extended keying portions on the key members will abut one another during mating to prevent proper mating of the connectors.

The key members typically include a portion having a polygonal cross-section and are secured within passageways in the connectors having similar cross-sections. The number of sides of the polygonal shape determines the number of possible orientations of the key members.

Many known polygonal keying systems are also not fully satisfactory. For example, in connectors containing multiple contacts, many such keying systems are capable of preventing incorrectly matched connectors from completely mating with one another, but are not effective in preventing one or more of the individual contacts within the connectors from mating. In many applications, the improper mating of even one pair of contacts in incorrectly matched connectors can close a circuit and cause damage to the circuit.

Also, polygonal keying systems are usually limited in the number of keying combinations they can provide. Most polygonal keying systems include keys having a portion of hexagonal cross-section providing six keying orientations. Although, in theory, the number of keying combinations can be increased by increasing the number of sides of the polygonal portion, in practice, orienting and positioning of keys having more than about six keying orientations becomes quite difficult, particularly in small connectors wherein the key members are also quite small and rather difficult to handle.

SUMMARY OF THE INVENTION

According to one aspect of the present invention, an hermaphroditic keying system for electrical connectors is provided which comprises a first connector having first and second pairs of diametrically opposed key positions thereon; a pair of keys at a selected one of the first and second pairs of diametrically opposed key positions; a second connector complementary with the first connector and having first and second pairs of diametrically opposed key-receiving positions thereon, the first and second pairs of key-receiving positions being aligned with the first and second key positions, respectively, when the first and second connectors are mated; and a pair of key-receiving openings at a selected one of the first and second pairs of diametrically opposed key-receiving positions, whereby the second connector is permitted to mate with the first connector when the pair of key-receiving openings is in alignment with the pair of keys and is not permitted to mate when the pair of key-receiving openings is not in alignment with the pair of keys.

The hermaphroditic keying system of the invention provides two possible keying configurations to permit mating of a properly keyed pair of complementary connectors and to prevent mating of a pair of complementary connectors which are not intended to be mated. The invention is thus effective in preventing unmatched complementary connectors from being improperly mated and avoids the risk of serious damage to circuits improperly connected thereby.

According to a presently preferred embodiment, the pair of keys comprises a pair of projections extending from adjacent diametrically opposed corners of the first connector, and the pair of key-receiving openings comprises a pair of slots adjacent diametrically opposed corners of the complementary connector. By positioning the projections and slots at diametrically opposed locations on the connectors, the keying system is made hermaphroditic in nature such that the keying system is independent of the orientation of the connectors themselves (i.e., independent of whether the connectors are right side up or upside down with respect to each other), and is independent of any polarizing features provided on the connectors. This greatly simplifies manufacture and assembly of the connectors.

The hermaphroditic keying system is also effective in preventing a connector having projections thereon from mating with an unkeyed connector by interfering with the housing or another portion of the unkeyed connector.

According to a second aspect of the invention, a keying system for electrical connectors is provided which includes a first keying means and a second keying means which cooperate to significantly increase the number of possible keying orientations that would otherwise be provided by the first keying means itself. According to the second aspect of the invention, a keying system for electrical connectors is provided which comprises first keying means on one connector cooperable with an opposing first keying means on a complementary connector for permitting mating of the connectors upon proper orientation of the first keying means and the first opposing keying means with respect to one another, and for preventing mating of the connectors upon improper orientation of the first keying means and the first opposing keying means with respect to one another, the first keying means having a given number of possible keying orientations; and second keying means on the one connector cooperable with second opposing keying means on the complementary connector for permitting mating of the connectors upon proper orientation of the second keying means and the second opposing keying means with respect to one another, and for preventing mating of the connectors upon improper orientation of the second keying means and the second opposing keying means with respect to one another, the second keying means comprising a plurality of key positions on the one connector and a plurality of key-receiving positions on the complementary connector, the plurality of key positions being adapted to be aligned with the plurality of key-receiving positions when the connectors are mated, and a key positioned at each of a selected one or more of the plurality of key positions and a key-receiving opening positioned at each of a selected one or more of the plurality of key-receiving positions for permitting mating of the connectors when each key is in alignment with each key-receiving opening, and for preventing mating of the connectors when each key is not in alignment with each key-receiving opening, whereby the first keying means and the second keying means cooperate to increase the given number of possible keying orientations.

According to a presently preferred embodiment of the second aspect of the invention, the first keying means comprises polygonal keying means and the second keying means comprises the hermaphroditic keying means of the invention described above. The hermaphroditic keying means provides two keying configurations for each keying orientation of the polygonal keying means; and, accordingly, if the polygonal keying means comprises hexagonal keying means providing six possible keying orientations, the second keying means doubles the number of possible keying configurations to twelve. The invention thus provides a convenient way of increasing the number of possible keying configurations of a polygonal keying means without increasing the number of sides of the polygon.

Further advantages and specific details of the invention will become apparent hereinafter in conjunction with the following detailed description of a presently preferred embodiment.

DETAILED DESCRIPTION OF THE PREFERRED EMBODIMENT

Figure 1:
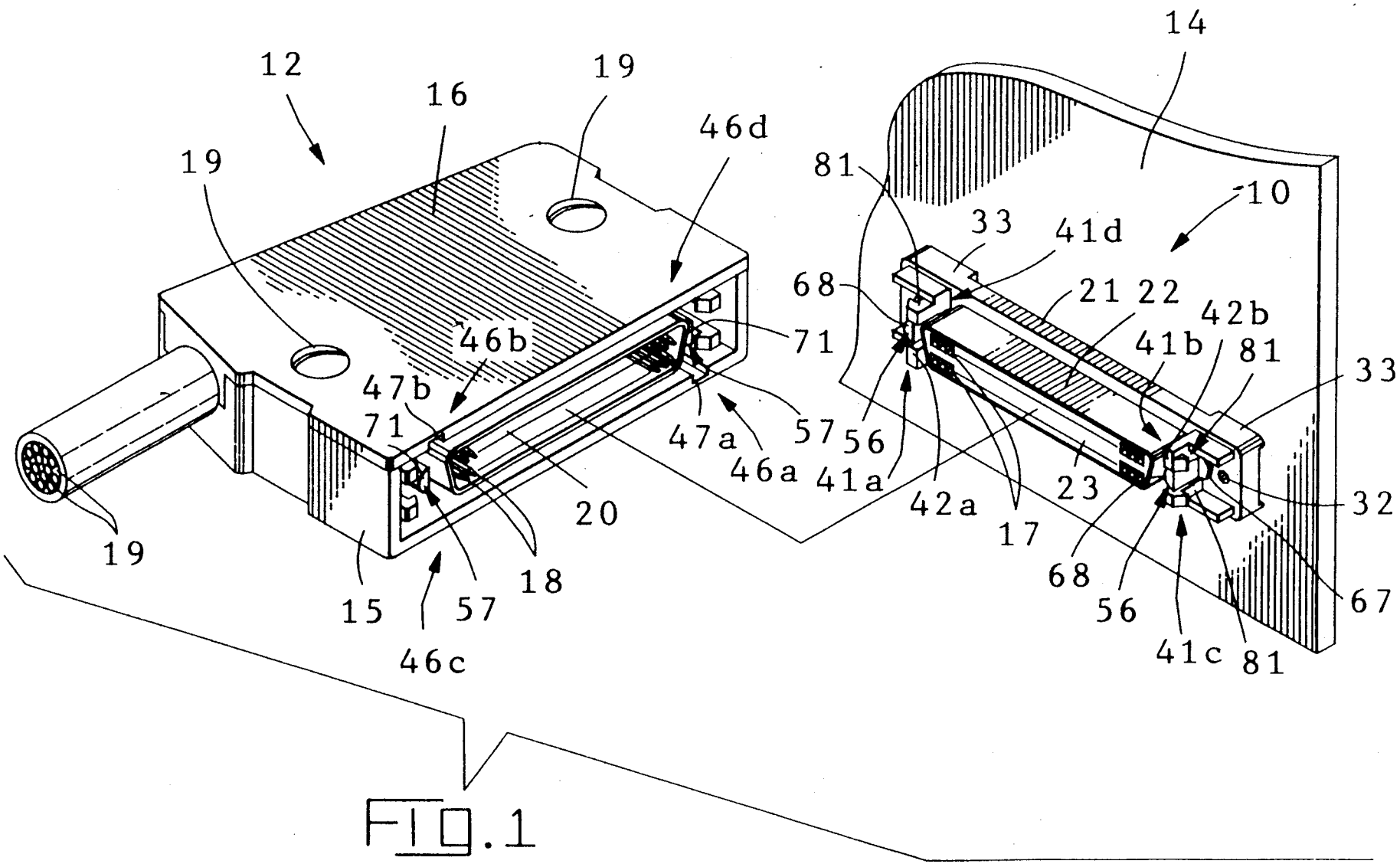
FIG. 1 is a perspective view of a pair of complementary electrical connectors incorporating a keying system according to a presently preferred embodiment of the invention.

FIG. 1 is a perspective view of a pair of complementary electrical connectors 10 and 12 incorporating the keying system of the present invention. In the embodiment illustrated, the connectors comprise high-density connectors containing two rows of electrical contacts which are adapted to be mated to complete a plurality of electrical circuits through the connectors.

Connector 10 is designed to be mounted to a printed circuit board or other panel designated by reference numeral 14; and in the embodiment illustrated and described herein, comprises a vertically oriented, receptacle connector having a plurality of female contacts 17. This embodiment is intended to be exemplary only. Connector 10 can also comprise a right angle connector and can be of either plug or receptacle type as required for a particular application.

Connector 10 comprises a housing 21 formed of die-cast zinc or other suitable material, a drawn metal shroud 22, and a plastic header 23 formed of suitable, thermoplastic, insulating material. Header 23 has a plurality of passageways 24 extending therethrough for receiving female contacts 17 and is supported within shroud 22. Shroud 22 is, in turn, supported within a D-shaped polarizing aperture in housing 21 to form connector 10.

Housing 21 further includes a plurality of downwardly extending solder posts 31 to mount the connector to printed circuit board 14. Connector 10 may also be mounted to board 14 by extending mounting screws (not shown) through threaded mounting apertures 32 in the housing, and additionally includes a plurality of mounting feet 33 which are adapted to rest upon the surface of the printed circuit board when the connector is mounted to the board.

Connector 12 comprises a cable-terminating connector which is adapted to mate with connector 10 to complete electrical circuits through the connectors. In the embodiment, illustrated herein, connector 12 comprises a right-angle plug connector having a plurality of male contacts 18 which are electrically connected to external circuitry via cables 19.

Connector 12, which is illustrated only schematically herein, includes a housing comprised of a lower back shell 15 and a cover 16. The housing supports a plastic insert 20 which is adapted to support the plurality of contacts 18. A pair of locking screws 19 are provided to lock the connector 12 in an assembled condition as shown in FIG. 1.

Connectors 10 and 12 are particularly designed for use in applications in which a plurality of identical connectors are mounted in close proximity to one another. For example, printed circuit board 14 can comprise a panel on a computer or the like and contain a plurality of connectors 10 to permit various external equipment to be connected to the computer via a plurality of complementary connectors 12 coupled to the external equipment. In such applications, it is important to ensure that each connector be mated with the correct complementary connector as mismatching of connector pairs can result in damage to the electrical circuits improperly connected thereby.

To ensure that each connector 10 can mate with only the correct complementary connector 12, the connectors include a keying system to prevent incorrect connector pairs from being mated. More particularly, the connectors include a first keying means which comprises a polygonal keying means and a second keying means which comprises an hermaphroditic keying means. The polygonal keying means includes pairs of keys 56 and 57 mounted adjacent opposite ends of connectors 10 and 12, respectively, which include keying portions 68 and 71, respectively, which can be positioned in any selected one of a plurality of orientations. As is known to those skilled in the art, if the keys 56 of connector 10 and the keys 57 of connector 12 are properly oriented with respect to one another, the keying portions thereof pass by each other as the connectors are mated, permitting the connectors to properly mate. If, however, the keys are not properly oriented with respect to one another, the keying portions will impinge against one another during mating to prevent the connectors from being mated.

The hermaphroditic keying means includes a pair of projections 42*a* and 42*b* (see FIG. 3) positioned adjacent diametrically opposed corners of connector 10 which are adapted to be received within a pair of slots 47*a* and 47*b* (FIG. 1) located adjacent diametrically opposed corners of connector 12. With keys 56 and 57 oriented to permit mating of connectors 10 and 12, if projections 42*a* and 42*b* are properly oriented with respect to slots 47*a* and 47*b*, the projections will enter into the slots as connectors 10 and 12 are mated, permitting the connectors to properly mate. If, however, with keys 56 and 57 oriented to permit mating of connectors 10 and 12, the projections and slots are not properly oriented with respect to one another, the projections will not enter into the slots but will impinge upon the housing or backshell of connector 12 preventing the connectors from properly mating.

As will become apparent hereinafter, the polygonal keying means and the hermaphroditic keying means function independently to permit a connector 10 to mate with only the proper complementary connector 12, but cooperate to provide a keying system which is highly effective and which provides a large number of possible keying orientations.

Figure 2:
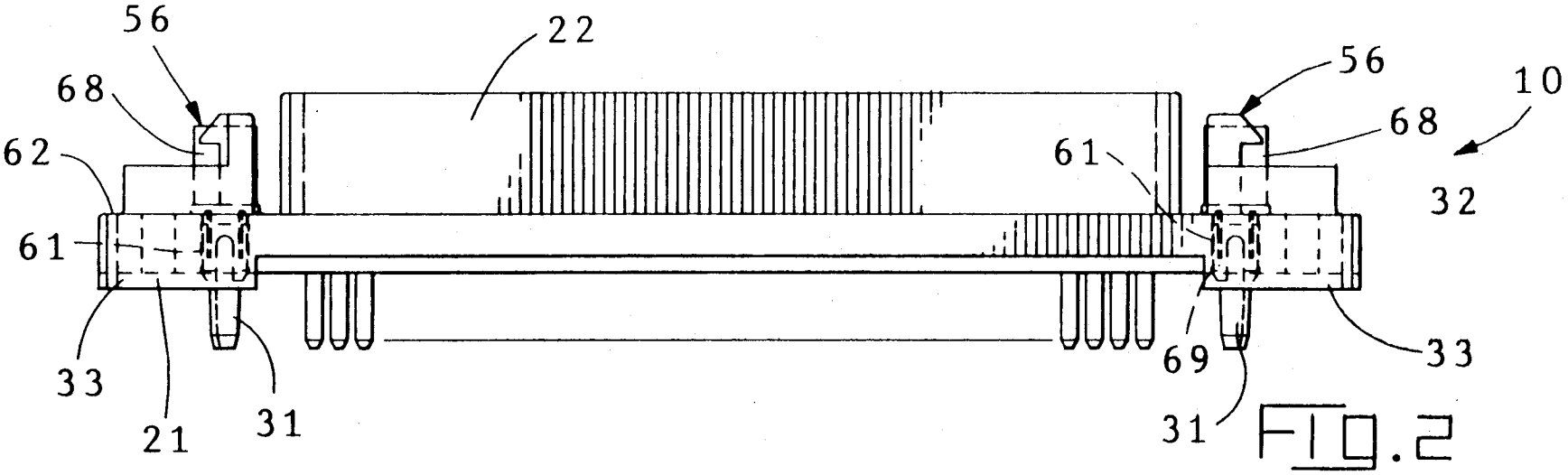
FIG. 2 is a front view of the board-mounted connector of FIG. 1.

As shown in FIG. 2, the polygonal keying means of connector 10 includes a pair of key-receiving passageways 61 adjacent opposite ends of housing 21. Each passageway 61 extends into housing 21 from upper surface 62 thereof and is adapted to receive one of the pair of keys 56 therein. Each key 56 comprises a generally elongated member having a body portion 67, a keying portion 68, and a retention portion 69 (illustrated in dotted line on the right side of FIG. 2). Body portion 67 is formed to have a cross-section shaped in a regular polygonal shape, preferably, a hexagonal shape, to define the different orientations of key 56. Keying portion 68 is of generally semi-circular cross-section, and extends upwardly from body portion 67, covering approximately one-half of the upper surface of body portion 67. Retention portion 69 extends downwardly from the body portion 67 and is adapted to retain key 56 in a passageway 61.

Figure 4:
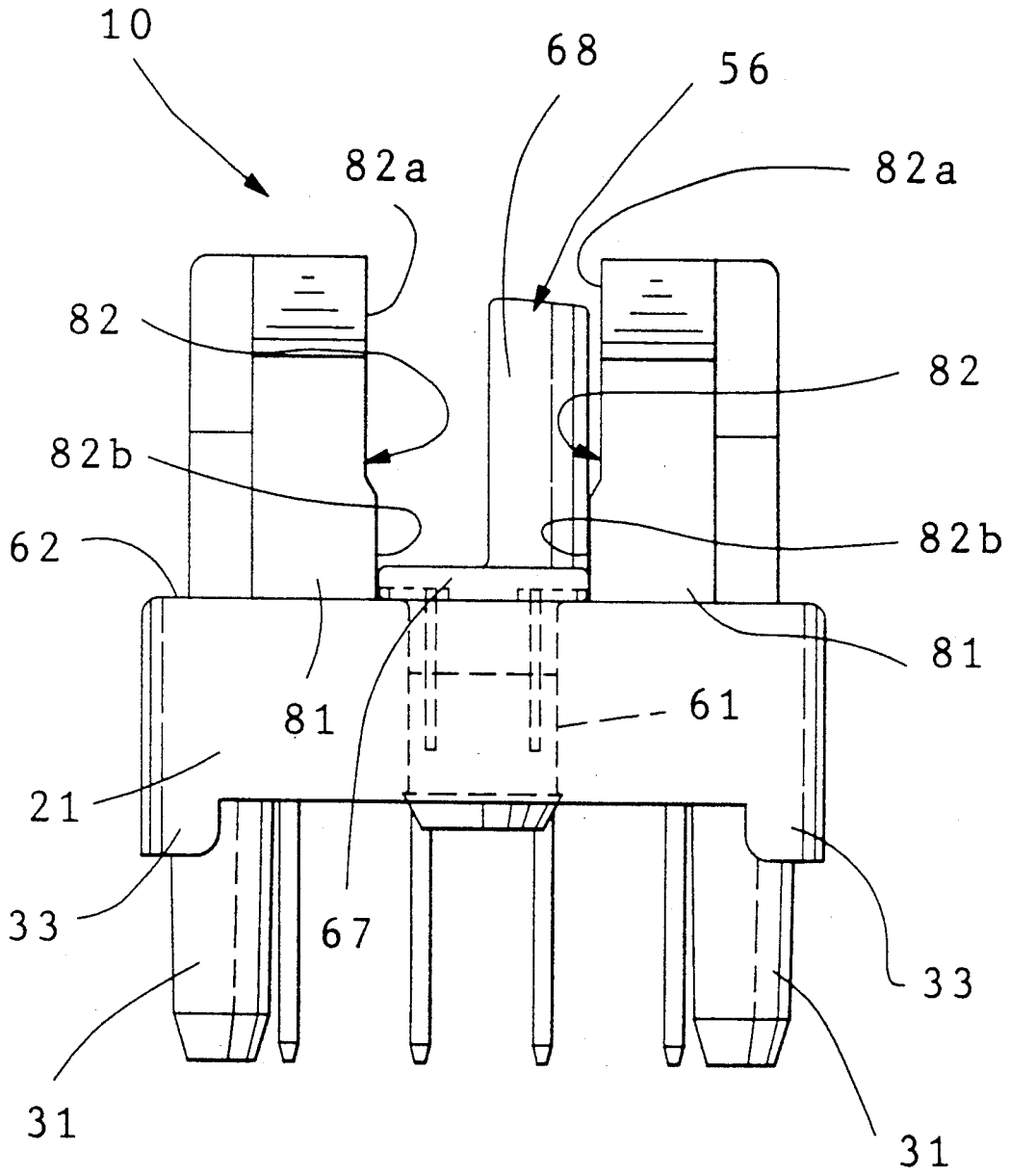
FIG. 4 is a side view of the board-mounted connector of FIGS. 1–3.

Housing 21 is also provided with a pair of key retention features 81 which extend upwardly from upper surface 62 of housing 21 and which are positioned on diametrically opposed sides of each key-receiving passageway 61. Key retention features 81 have facing internal surfaces 82 which are parallel to one another and which include a first upper surface portion 82*a* and a second lower surface portion 82*b* as best shown in FIG. 4.

Figure 3:
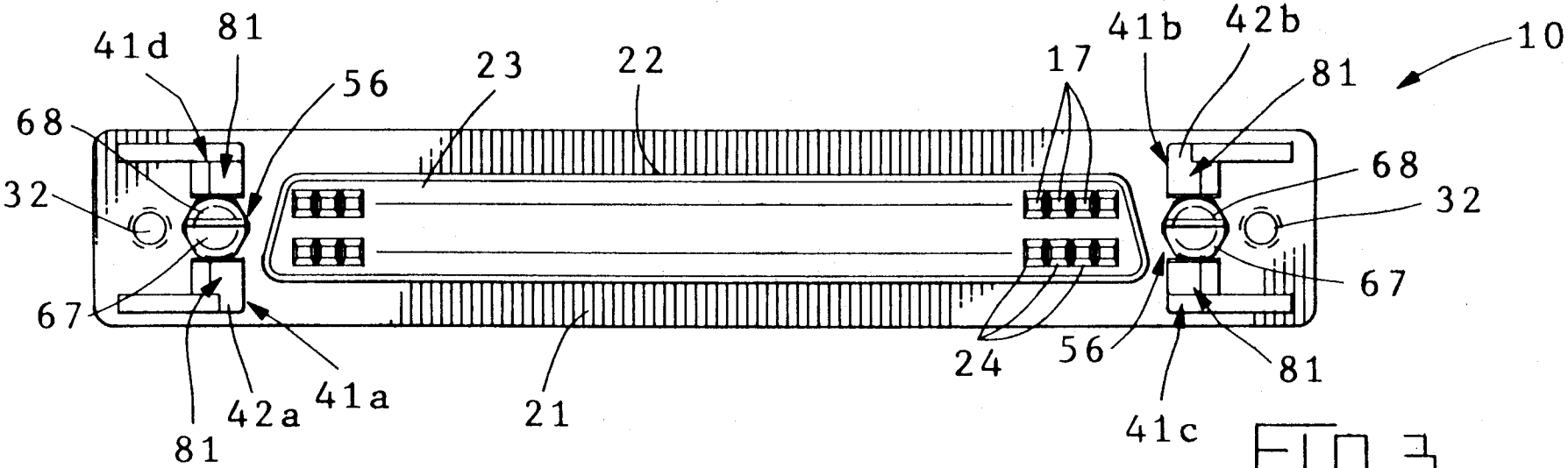
FIG. 3 is a top view of the board-mounted connector of FIGS. 1 and 2.

A key 56 is adapted to be retained within each of the key-receiving passageways 61 of connector 10 with the keying portions 68 thereof oriented at any selected one of a plurality of desired orientations. FIGS. 2–4 illustrate keys 56 at one possible orientation, and FIG. 1 illustrates keys 56 in a different orientation. As is known to those skilled in the art, the number of possible orientations of the keys equals the number of sides of polygonal body portion 67. A key having a body portion of hexagonal shape therefore has six keying orientations. Preferably, both keys 56 are positioned at the same orientation.

In the embodiment illustrated, each key 56 includes a hexagonal body portion and is prevented from rotating out of its selected orientation by surfaces 82*b* of retention features 81. In particular, surfaces 82*b* are positioned to receive body portion 67 therebetween with a rather close fit, and cooperate with the flat sides of hexagonal body portion 67 to prevent rotation of body portion 67 and of the key in general after the key has been oriented to the desired orientation and inserted into passageway 61.

Keys 56 on connector 10 are adapted to cooperate with keys 57 on connector 12 to permit properly keyed connectors to mate and to prevent improperly keyed connectors from mating. More particularly, as in known in the art, if keying portions 68 of keys 56 are properly oriented with keying portions 71 on keys 57, the keying portions will pass by one another during mating of the connectors to permit the connectors to properly mate. If the keys are not properly oriented with respect to one another, however, their keying portions will impinge against one another during mating to prevent the connectors from mating. The use of two spaced keys positioned at substantially opposite sides of the connectors is desirable to ensure that none of the individual contacts 17 and 18 on connectors 10 and 12, respectively, will mate with one another. If only one key is utilized, there is a risk that one or more of the contacts can mate, even if the connectors as a whole do not mate, and the mating of even one pair of contacts can damage an electrical circuit improperly connected thereby.

The hermaphroditic keying means of the invention includes a plurality of key positions 41*a*, 41*b*, 41*c* and 41*d* (best shown in FIG. 3) adapted to be aligned with a plurality of key-receiving positions 46*a*, 46*b*, 46*c* and 46*d* on connector 12. The key positions and the key-receiving positions are located adjacent the four corners of the connectors, and define two pairs of diametrically opposed key positions (i.e., positions 41*a* and 41*b* and positions 41*c* and 41*d*) and two pairs of diametrically opposed key-receiving positions (i.e., positions 46*a* and 46*b* and positions 46*c* and 46*d*). A pair of small projections or keys (e.g., keys 42*a* and 42*b*) are provided at one of the pairs of key positions (e.g., at positions 41*a* and 41*b*) and not at the other of the pair of positions. Similarly, a pair of openings or slots (e.g., slots 47*a* and 47*b*) are provided at one of the pair of key-receiving positions (e.g., at positions 46*a* and 46*b*) and not at the other pair of positions. Preferably, the keys comprise small projections or extensions formed on the back sides of the key retention features 81 of connector 10 (note that the projections are not present at key positions 41*c* and 41*d*). Preferably also, the slots are formed in the edges of the back shell 15 and the cover 16 of connector 12 (note that there are no slots at key-receiving positions 46*c* and 46*d*). Projections 42*a* and 42*b* extend upwardly from upper surface 62 a greater distance than keys 56, as best seen in FIGS. 3 and 4. The keys 42*a* and 42*b* on connector 10 are adapted to extend into slots 47*a* and 47*b* in connector 12 when the connectors are mated to permit the connectors to properly mate. Alternatively, the keys can be provided at positions 41*c* and 41*d* of connector 10 and not at positions 41*a* and 41*b*. In such circumstances, connectors 10 and 12 will mate only if slots are provided at key-receiving positions 46*c* and 46*d*, respectively, rather than at positions 46*a* and 46*b*. Thus, the hermaphroditic keying means of the present invention permits connectors 10 and 12 to mate when pairs of keys and slots are in alignment when the connectors are mated, and prevents connectors 10 and 12 from mating when the pairs of keys and slots are not in alignment when the connectors are mated. The hermaphroditic keying means thus provides two possible keying orientations to permit the mating of the proper complementary connectors and to prevent the mating of improper complementary connectors.

The hermaphroditic keying means is hermaphroditic because the keys of each pair of possible key positions and the slots of each pair of possible slot positions are located at diametrically opposed positions on the connectors. Because it is hermaphroditic, the keying means is independent of the orientation of the connectors themselves (i.e., independent of whether the connectors are right side up or upside down with respect to each other), and independent of any polarizing features on the connectors. This permits manufacture of the connectors to be greatly simplified.

The hermaphroditic keying means is also effective in preventing connector 10 from mating with an unkeyed complementary connector 12 inasmuch as the projections 42 thereon will impinge upon the housing or another portion of an unkeyed connector to prevent the connectors from mating.

The hermaphroditic keying means of the invention can be utilized alone or in combination with the polygonal keying means described above. When used with the polygonal keying means, the hermaphroditic keying means effects a doubling of the possible number of keying orientations available from the polygonal keying means alone by providing two possible hermaphroditic keying orientations for each orientation of the polygonal keying means. The hermaphroditic keying means of the invention combined with a hexagonal keying means thus permits twelve possible keying orientations for the connectors, significantly increasing a customer's flexibility.

While what has been described constitutes a presently preferred embodiment of the invention, it should be recognized that the invention could take many other forms. For example, although a polygonal keying means has been described herein, it should be understood that the hermaphroditic keying means of the invention could double the number of possible keying combinations of other types of keying means as well. Because the invention can take numerous forms, it should be understood that the invention should be limited only insofar as is required by the scope of the following claims.

I claim:

1. An electrical connector comprising:

a housing having contacts secured therein, said housing having at least a pair of members integral with and extending upwardly from a surface thereof;

a first keying system including at least one key supported by said housing and extending outwardly from said surface, said at least one key being adapted to cooperate with at least one opposing key on a complementary connector during mating of said connector and said complementary connector, and being adapted to be oriented in any selected one of a plurality of possible keying orientations to provide a given number of keying combinations between said connector and said complementary connector; and a second keying system including a pair of spaced projections integral with and extending upwardly from said surface along said pair of members for preventing said connector from mating with a complementary connector with which it is not intended to mate, said pair of spaced projections being symmetrically disposed about said surface and extending outwardly toward the periphery of said surface, said projections being adapted to be received within an aligned pair of spaced openings in a complementary connector with which said connector is intended to mate.

2. An electrical connector as recited in claim 1 wherein each of said pair of spaced projections extends outwardly from said housing surface by a greater distance than said at least one key.

3. An electrical connector as recited in claim 1 wherein said pair of spaced projections extend from diametrically opposed positions on said housing surface.

4. An electrical connector as recited in claim 3 wherein said housing surface is of generally rectangular shape and wherein said diametrically opposed positions are adjacent diametrically opposed corners of said housing surface.

5. An electrical connector as recited in claim 1 wherein said connector housing includes first and second pairs of diametrically opposed key positions on said surface and wherein said pair of projections comprises a pair of identical projections positioned at a selected one of said first and second pairs of diametrically opposed key positions and not at the other of said first and second pairs of diametrically opposed key positions to permit said connector to mate with a complementary connector only when said selected pair of diametrically opposed key positions is aligned with a pair of spaced openings in said complementary connector and to provide for a doubling of said given number of keying combinations.

6. An electrical connector as recited in claim 1 wherein said at least one key includes at least a portion of polygonal cross-section and is rotatable to any selected one of a plurality of possible keying orientations equal to the number of sides of said polygonal portion.

7. An electrical connector as recited in claim 6 wherein said at least one key comprises a pair of keys adapted to cooperate with a pair of opposing keys on a complementary connector.

8. An electrical connector defining a surface, said connector having at least a pair of members integral with and extending upwardly from said surface, said connector having a first keying system including at least one key for permitting selective intermating with a keyed complementary connector, the improvement comprising a second keying system, said second keying system comprising a pair of projections extending upwardly from said surface along said pair of members, said projections symmetrically disposed about said surface and extending outwardly toward the periphery of said surface.

9. An electrical connector as recited in claim 8 wherein the projections of said second keying system extend upwardly from said surface a greater distance than said at least one key of said first keying system.

10. An electrical connector as recited in claim 8 further comprising a complementary connector having channels adapted to receive said projections of said second keying system as said connector and said complementary connector are mated.

11. An electrical connector system, comprising:

a first electrical connector defining a surface and having at least a pair of members integral with and extending upwardly from said surface, said connector having a first keying system including at least one key for permitting selective intermating of said connector with a keyed complementary connector, said first electrical connector also having a second keying system including a pair of projections extending upwardly from said surface along respective ones of said pair of members, said projections symmetrically disposed about said surface and extending outwardly toward the periphery of said surface; and a second electrical connector complementary to said first electrical connector, said second electrical connector having channels adapted to receive said projections of said second keying system as said first and second connectors are mated.

12. An electrical connector system as recited in claim 11 wherein said first electrical connector is a board mount connector and said electrical connector is a cable terminated connector.

* * * * *